US011234063B2

(12) United States Patent
Murray et al.

(10) Patent No.: US 11,234,063 B2
(45) Date of Patent: Jan. 25, 2022

(54) LOW PROFILE LOUDSPEAKERS

(71) Applicant: Bose Corporation, Framingham, MA (US)

(72) Inventors: Gabriel Lloyd Murray, Shrewsbury, MA (US); Greg J. Zastoupil, Norh Grafton, MA (US); Joseph J. Kutil, Franklin, MA (US); Kevin Joseph Brousseau, Brighton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/379,230

(22) Filed: Apr. 9, 2019

(65) Prior Publication Data

US 2020/0329290 A1 Oct. 15, 2020

(51) Int. Cl.
*H04R 1/02* (2006.01)
*H04R 1/28* (2006.01)
(Continued)

(52) U.S. Cl.
CPC ..... *H04R 1/025* (2013.01); *H04R 1/026* (2013.01); *H04R 1/2811* (2013.01); *H04R 3/12* (2013.01);
(Continued)

(58) Field of Classification Search
CPC H04R 31/006; H04R 1/345; H04R 2201/021; H04R 1/2819; H04R 1/2842;
(Continued)

(56) References Cited

U.S. PATENT DOCUMENTS 2,694,463 A * 11/1954 Robbins ..... H04R 1/2842 181/155
4,114,327 A * 9/1978 Williams ..... F16B 7/1472 52/28
(Continued)

FOREIGN PATENT DOCUMENTS

JP H02152397 A 6/1990

OTHER PUBLICATIONS

International Search Report and Written Opinion dated Jul. 10, 2020 for PCT/US2020/027257.

*Primary Examiner* — Alexander Krzystan
*Assistant Examiner* — Julie X Dang
(74) *Attorney, Agent, or Firm* — Bose Corporation

(57) ABSTRACT

A ceiling tile loudspeaker includes an acoustic enclosure that defines an acoustic cavity. An electro-acoustic transducer is supported by the enclosure such that a first radiating surface of the electro-acoustic transducer radiates acoustic energy into the acoustic cavity and a second radiating surface of the electro-acoustic transducer radiates acoustic energy outward away from the acoustic enclosure. A first baffle is disposed within the acoustic cavity. The loudspeaker also includes a plurality of partitions, which, together with the first baffle, defines a plurality of ports that acoustically couple the acoustic cavity to an exterior of the enclosure. Each of the plurality of ports includes a first open end, a second open end, and a central axis extending therebetween. The ports are arranged such that their central axes lie in a plane that is substantially perpendicular to a motion axis of the electro-acoustic transducer.

24 Claims, 7 Drawing Sheets

(51) Int. Cl.
*H04R 3/12* (2006.01)
*H04R 31/00* (2006.01)

(52) U.S. Cl.
CPC ..... *H04R 31/006* (2013.01); *H04R 2201/021* (2013.01)

(58) Field of Classification Search
CPC .... H04R 2201/34; H04R 1/023; H04R 1/025; H04R 1/26; H04R 1/288; H04R 2201/029; H04R 1/026
USPC ..... 381/160, 182, 152, 186, 361, 384
See application file for complete search history.

(56) References Cited

U.S. PATENT DOCUMENTS 4,330,691 A 5/1982 Gordon
5,088,574 A * 2/1992 Kertesz, III ..... H04R 1/025 181/150
5,637,840 A * 6/1997 Kim ..... H04R 11/14 181/152
5,699,641 A * 12/1997 Tinen ..... E04B 9/006 248/343
6,062,339 A 5/2000 Hathaway
6,578,660 B2 * 6/2003 Taylor ..... H04R 1/345 181/154
6,625,292 B2 * 9/2003 Proni ..... H04R 1/02 381/345
8,002,078 B2 8/2011 Chan et al.
9,473,848 B2 10/2016 Chick et al.
2003/0091206 A1 5/2003 Proni
2004/0190736 A1 * 9/2004 Gelow ..... H04R 1/34 381/182
2005/0175206 A1 * 8/2005 Bearden ..... H04R 1/2826 381/338
2010/0189295 A1 * 7/2010 Datz ..... H04R 1/30 381/340
2011/0007921 A1 1/2011 Stewart, Jr. et al.
2013/0327585 A1 * 12/2013 Murray ..... H04R 1/2826 181/199
2014/0153750 A1 * 6/2014 Konno ..... H04R 1/323 381/190
2014/0291065 A1 * 10/2014 Kim ..... H04R 1/2826 181/199

* cited by examiner

LOW PROFILE LOUDSPEAKERS

BACKGROUND

This disclosure relates to low profile loudspeakers. More particularly, this disclosure relates to a low-profile loudspeaker with a ported enclosure that is configured to be supported by a cross-tee grid of a drop ceiling in place of a ceiling tile.

SUMMARY

All examples and features mentioned below can be combined in any technically possible way.

In one aspect, a ceiling tile loudspeaker includes an acoustic enclosure that defines an acoustic cavity. An electro-acoustic transducer is supported by the enclosure such that a first radiating surface of the electro-acoustic transducer radiates acoustic energy into the acoustic cavity and a second radiating surface of the electro-acoustic transducer radiates acoustic energy outward away from the acoustic enclosure. A first baffle is disposed within the acoustic cavity. The loudspeaker also includes a plurality of partitions, which, together with the first baffle, defines a plurality of ports that acoustically couple the acoustic cavity to an exterior of the enclosure. Each of the plurality of ports includes a first open end, a second open end, and a central axis extending therebetween. The ports are arranged such that their central axes lie in a plane that is substantially perpendicular to a motion axis of the electro-acoustic transducer.

Implementations may include one of the following features, or any combination thereof.

In some implementations, the central axes of the ports extend along spiral curves.

In certain implementations, each of the ports has substantially constant cross-section area along its length from the first open end to the second open end.

In some cases, the plurality of partitions comprises a plurality of ribs.

In certain cases, the plurality of partitions includes a plurality of bulbs disposed at distal ends of respective ones of the ribs. The bulbs help to keep the respective cross-sectional areas of the ports constant.

In some examples, respective inner edge surfaces of the partitions are tapered so as to form a waveguide around the second radiating surface of the electro-acoustic transducer.

In certain examples, the electro-acoustic transducer is a full-range driver.

In some implementations, the acoustic enclosure defines a first opening through which the second surface of the electro-acoustic transducer radiates acoustic energy, and wherein respective inner edge surfaces of the partitions are tapered to form a substantially funnel shaped cavity between the second radiating surface of the electro-acoustic transducer and the first opening such that acoustic energy radiated from the second surface of the electro-acoustic transducer is funneled towards the first opening.

In certain implementations, a phase plug is disposed within the funnel shaped cavity.

In some cases, the partitions are configured to direct an air flow exhausted from the ports around the motion axis of the electro-acoustic transducer.

In certain cases, the second open ends of the ports are arranged in a radial array about the motion axis of the electro-acoustic transducer.

In some examples, the acoustic enclosure is configured to rest within a 2 foot by 2 foot opening in a drop ceiling.

In certain examples, the ceiling tile loudspeaker also includes a first opening in acoustic enclosure and a second opening in the first baffle. The electro-acoustic transducer is mounted to the first baffle such that acoustic energy radiated from the second radiating surface of the electro-acoustic transducer passes through the first and second openings. The second open ends of the ports are arranged to exhaust an air flow into a cavity disposed between the second radiating surface of the electro-acoustic transducer and the first opening.

In some implementations, the electro-acoustic transducer is a subwoofer.

In certain implementations, the partitions are formed integrally with the first baffle.

In some cases, the ceiling tile loudspeaker also includes a second baffle, and the partitions are disposed between the first and second baffles. The first and second baffles and the partitions together define the ports.

In certain cases, the partitions are formed integrally with the second baffle.

In some examples, a recess is formed within a bottom wall of the acoustic enclosure to receive the second baffle.

In certain examples, a recess is formed about an outer periphery of a bottom surface of a bottom wall of the acoustic enclosure, and the recess is configured to engage cross-tee members of a drop ceiling to support the ceiling tile loudspeaker.

In another aspect, a ceiling tile loudspeaker includes an acoustic enclosure that defines an acoustic cavity and a first opening. An electro-acoustic transducer is supported by the enclosure such that a first radiating surface of the electro-acoustic transducer radiates acoustic energy into the acoustic cavity and a second radiating surface of the electro-acoustic transducer radiates acoustic energy outward away from the acoustic enclosure. A first baffle is disposed within the acoustic cavity. The first baffle defines a second opening. The ceiling tile loudspeaker also includes a plurality of partitions, which, together with the first baffle, defines a plurality of ports that acoustically couple the acoustic cavity to an exterior of the enclosure. Each of the plurality of ports includes a first open end, a second open end, and a central axis extending therebetween. The electro-acoustic transducer is mounted to the first baffle such that acoustic energy radiated from the second radiating surface of the electro-acoustic transducer passes through the first and second openings. The second open ends of the ports are arranged to exhaust an air flow into a cavity disposed between the second radiating surface of the electro-acoustic transducer and the first opening.

Implementations may include one of the above features, or any combination thereof.

DETAILED DESCRIPTION

A low-profile loudspeaker with a ported enclosure that is configured to be supported by a cross-tee grid of a drop ceiling in place of a ceiling tile. The ports (a/k/a "bass reflex ports") of the loudspeaker arranged orthogonally to the motion axis of a downward firing electro-acoustic transducer to provide compact profile. In addition, having the ports arranged orthogonally to the motion axis of the electro-acoustic transducer enables the ports and the transducer to radiate acoustic energy through a common opening in an acoustic enclosure such that a single, small grille can be used to cover both the electro-acoustic transducer and the ports.

Figure 1:
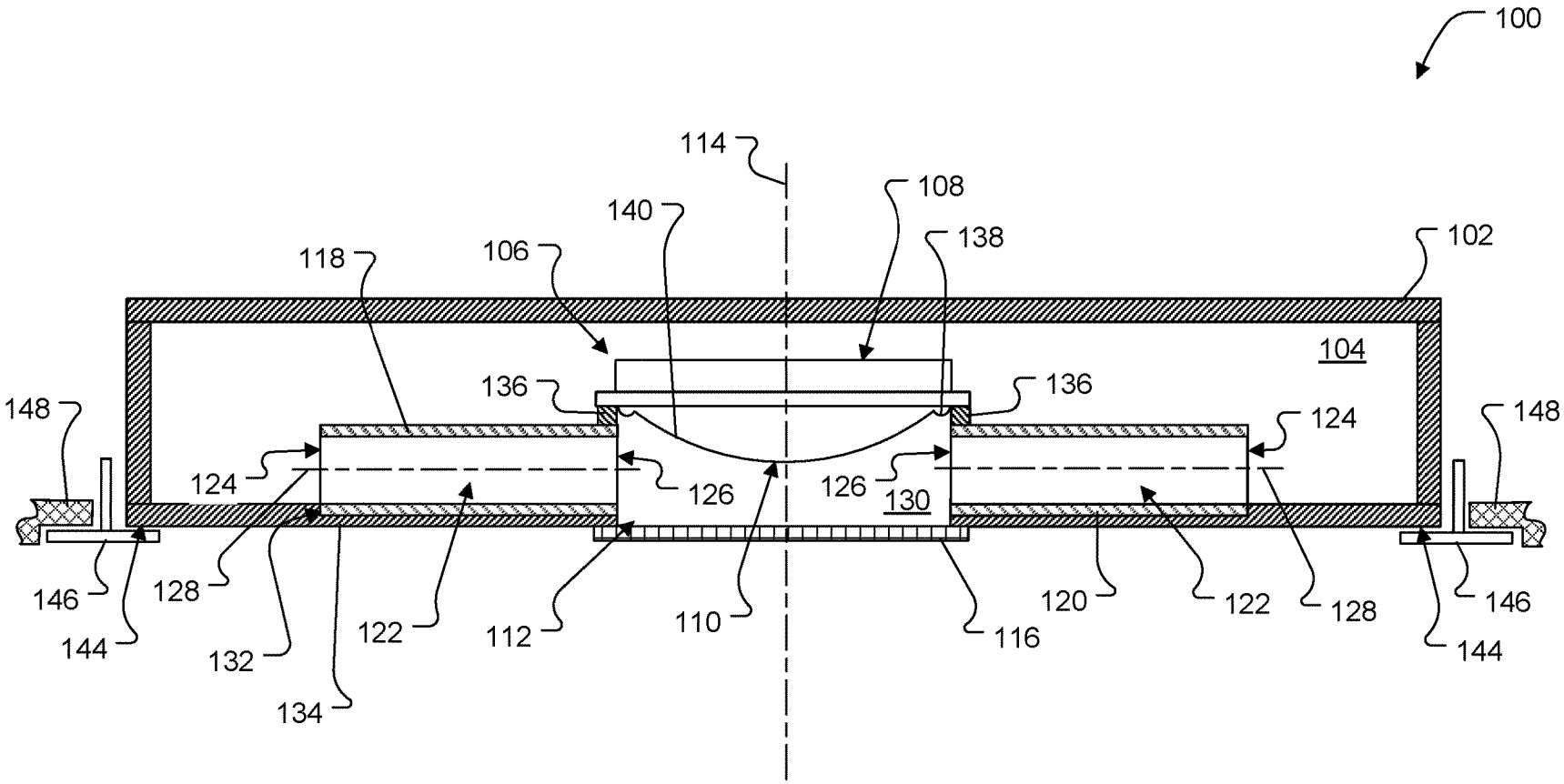
FIG. 1 is cross-sectional side view a ceiling tile loudspeaker shown installed in a cross-tee grid of a drop ceiling.

FIG. 1 is a cross-section side view of a ceiling tile loudspeaker 100 that includes an acoustic enclosure 102 that defines an acoustic cavity 104 and an electro-acoustic transducer 106 that is supported in the acoustic enclosure 102. The electro-acoustic transducer 106 is arranged such that a first (rear) radiating surface 108 of the electro-acoustic transducer 106 radiates acoustic energy into the acoustic cavity 104 and a second (front) radiating surface 110 of the electro-acoustic transducer 106 radiates acoustic energy outward away from the acoustic enclosure 102, via an opening 112 in the acoustic enclosure 102. The electro-acoustic transducer 106 is arranged such that its motion axis 114 is vertical relative to the direction of gravity. An acoustically transparent grille 116 covers the opening along the lower surface of the acoustic enclosure 102.

A pair of baffles 118, 120 are disposed within the acoustic enclosure 102 and are separated from each other by a plurality of partitions 200 (FIG. 2), which, together with the baffles 118, 120, define a plurality of ports 122 that acoustically couple the acoustic cavity 104 to an exterior of the acoustic enclosure 102. As used herein, the term "port" is intended to refer to a bass reflex port that enables the sound from the rear radiating surface of the electro-acoustic transducer to increase the efficiency of the system at low frequencies as compared to a typical sealed- or closed-box loudspeaker or an infinite baffle mounting. Each of the ports 122 includes a first open end 124, a second open end 126, and a central axis 128 extending therebetween. In the illustrated implementations, the ports 122 are arranged such that their central axes 128 lie in a plane that is substantially perpendicular to a motion axis 114 of the electro-acoustic transducer. In other implementations, the central axes of the ports may not be perpendicular to the motion axis of the electro-acoustic transducer. For example, in some implementations, the ports may be pitched at an angle rather than extending perpendicularly to the motion axis of the transducer.

Acoustic energy radiated from the first radiating surface 108 of the electro-acoustic transducer 106 into the acoustic cavity 104 enters through the first open ends 124 of the ports 122 and is exhausted from the second open ends 126 of the ports 122 into an exhaust cavity 130 that is acoustically coupled to the exterior of the acoustic enclosure 102 via the opening 112 in the acoustic enclosure 102.

In some implementations, a recess 132 may be formed in a bottom wall 134 of the acoustic enclosure 102 to accommodate the lower baffle 120, e.g., such that a top surface of the lower baffle 120 is substantially flush with an inner surface of the acoustic enclosure 102 (i.e., flush with a top surface of the bottom wall 134 of the acoustic enclosure 102).

The electro-acoustic transducer 106 is mounted (e.g., via fasteners) to a top surface of a first one of the baffles (a/k/a the "upper baffle") 118. In some cases, a standoff collar 136 is disposed between the electro-acoustic transducer 106 and the surface of the upper baffle 118. The standoff collar 136 can help to accommodate travel of a surround 136 of the electro-acoustic transducer 106 to enable farther excursion of the transducers diaphragm 138 for greater output. A gasket material may be disposed between the electro-acoustic transducer 106 and the standoff collar 136 and/or between the standoff collar 136 and the upper baffle 118 to provide an acoustic seal. The electro-acoustic transducer 106 is mounted to the upper baffle 118 such that acoustic energy radiated from the second radiating surface 110 of the electro-acoustic transducer 106 passes through coaxially arranged openings in the baffles 118, 120 and the opening 112 in the acoustic enclosure 102.

In the illustrated implementation, the electro-acoustic transducer 106 is in the form of a dome having a diaphragm 140 with a convex shape that extends at least partially into the exhaust cavity 130. By mounting the electro-acoustic transducer 106 on top of the baffle 118 and utilizing the space between the two baffles 118, 120 to create the ports 122, only a single opening 112 is required in the acoustic enclosure 102. This allows for a smaller grille 116 to be used that covers both the ports 122 and the electro-acoustic transducer 106. In addition, the partitions 200 (FIG. 2) increasing the effective length of the ports 122 allow for the overall height of the acoustic enclosure 102 to be shrunk and the fit within a low profile. In other implementations, the electro-acoustic transducer may have a diaphragm with a concave shape.

Figure 2:
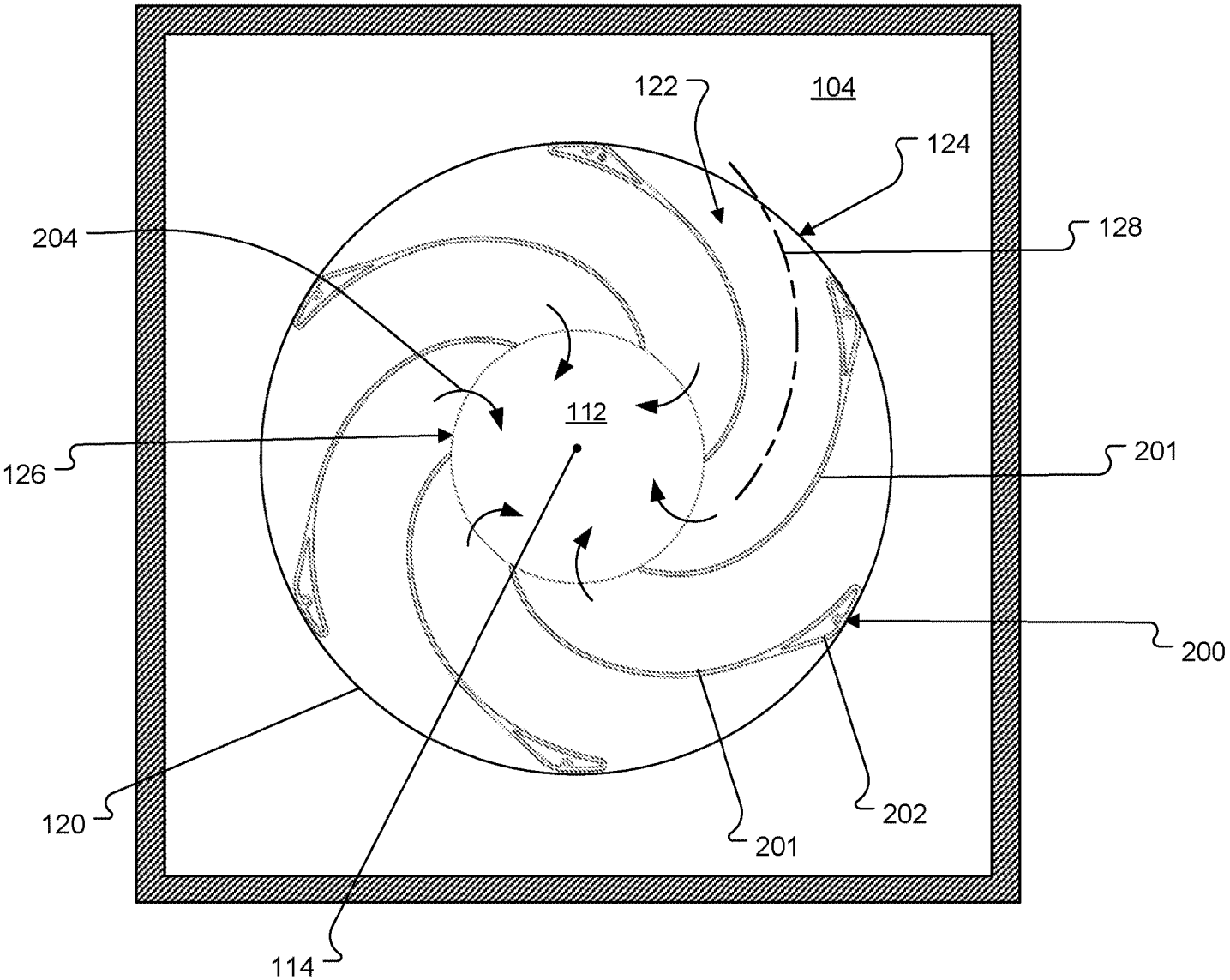
FIG. 2 is a top view of the ceiling tile loudspeaker of FIG. 1 shown with a top wall of an acoustic enclosure, an electro-acoustic transducer, and an upper baffle removed.

With reference to FIG. 2, the partitions 200 are arranged in a radial array about the motion axis 114 of the electro-acoustic transducer 106; i.e., such that the second open ends 126 of the ports 122 are also arranged in a radial array about the motion axis 114 of the electro-acoustic transducer 106. In the illustrated example, each of the partitions 200 includes a rib 201 that is spiral shaped such that the central axes 128 of the ports 122 extend along spiral curves; the ports 122 being defined, in part, by the space between adjacent ones of the partitions 200. As shown in the illustrated example, the partitions 200 may also include bulbs 202 that extend into the space between adjacent ones of the ribs 201, which can help to ensure that each of the ports 122 has a substantially constant cross-sectional area along its length from the first open end 124 to the second open end 126. As shown in FIG. 2, the baffles 118, 120 (only baffle 120 is shown in FIG. 2) can be round to help ensure all of the ports 122 have a consistent length.

The partitions 200 are configured to direct an air flow (arrows 204) exhausted from the ports 122 around the motion axis 114 of the electro-acoustic transducer (i.e., such that the vector of maximum flow velocity exiting the port 122 from its second open end 126 is not perpendicular to the motion axis 114 of the electro-acoustic transducer 106). This can help to prevent the air flow from buffeting off the diaphragm 140 (FIG. 1) of the electro-acoustic transducer 106, which may produce undesirable acoustic artifacts.

The ceiling tile loudspeaker 100 is configured to be supported by a cross-tee grid of a drop ceiling in place of a ceiling tile. As shown in FIG. 1 peripheral edges 144 of the acoustic enclosure 102 rest on horizontal supports provided by cross-tee members 146 of a drop ceiling. Adjacent openings in the cross-tee grid may be filled with conventional ceiling tiles 148 (partially shown in cross-section).

The electro-acoustic transducers 106 may be a commercially available "pancake" subwoofer. As used herein the term "subwoofer" should be understood to mean an electro-acoustic transducer having an operating frequency range of about 20 Hz to about 200 Hz. The acoustic enclosure 102 may be constructed from a planar material, such as plywood or medium density fiberboard (MDF). The baffles 118, 120 and/or the ribs 200 may be formed of plastic, wood, MDF or metal and may be formed in a machining or injection molding process.

In one specific example, the acoustic enclosure has a length and a width of about 2 feet each and is configured to replace a standard 2 foot by 2 foot (i.e., 24 inch by 24 inch) ceiling tile for a drop ceiling. In this example, the acoustic enclosure has a height of 4 inches or less. A 6 inch diameter opening is provided through the bottom surface of the acoustic enclosure for exiting acoustic energy. A dome style "pancake" subwoofer is chosen for this example. The subwoofer has an overall outer diameter of about 7 inches and a roughly 6 inch diameter dome-shaped diaphragm. The subwoofer having an overall height of less than 3 inches, about 2.25 inches in this case. about 16 inch diameter, ¼ inch thick, baffles along with ½ inch tall partitions provide 6 ports, with each port having an effective length of about 11-14 inches, and a cross-section area of 5 to 6 square-inches, e.g., 5.385 square-inches. Notably, the spiral curvature of the ribs/ports allows for longer port length than would be possible with a straight port and leaves ample clearance between the first open ends of the ports (at the outer circumferential edges of the baffles) and the inner surfaces of the sidewalls of the acoustic enclosure. The acoustic enclosure is formed of ½" thick plywood.

Other Implementations

While implementations have described which utilize two baffles to form the upper and lower bounds of the ports, in other implementations, only a single baffle may be used, e.g., to form the upper boundary of the ports and support the transducer, and the inner surface of the bottom wall of the acoustic enclosure may be used to define the lower boundary of the ports. In some implementations, the partitions may be formed integrally with one of the baffles, e.g., in a machining or injection molding operation. This can reduce the number of parts and simplify assembly. Integrally forming the partitions with one of the baffles also helps to reduces the number of interfaces (e.g., between the partitions and the baffle) that may otherwise need additional material to form an acoustic seal therebetween.

Although the implementations described above utilize spiral-shaped ribs and ports, in some implementations, the loudspeaker may utilize partitions that define substantially straight ports. In such cases, the ports may be configured such that the port axes are aligned with respective midpoints on the sidewalls of the acoustic enclosure, such that the axes bisect the sidewalls of the acoustic enclosure and/or such that the port axes intersect at the corners of the acoustic enclosure; i.e., in the region where adjacent sidewalls meet. As with the spiral configurations, the first open ends of the ports would be spaced away from the sidewalls of the acoustic enclosure to enable adequate airflow for the ports to be effective.

Figure 3:
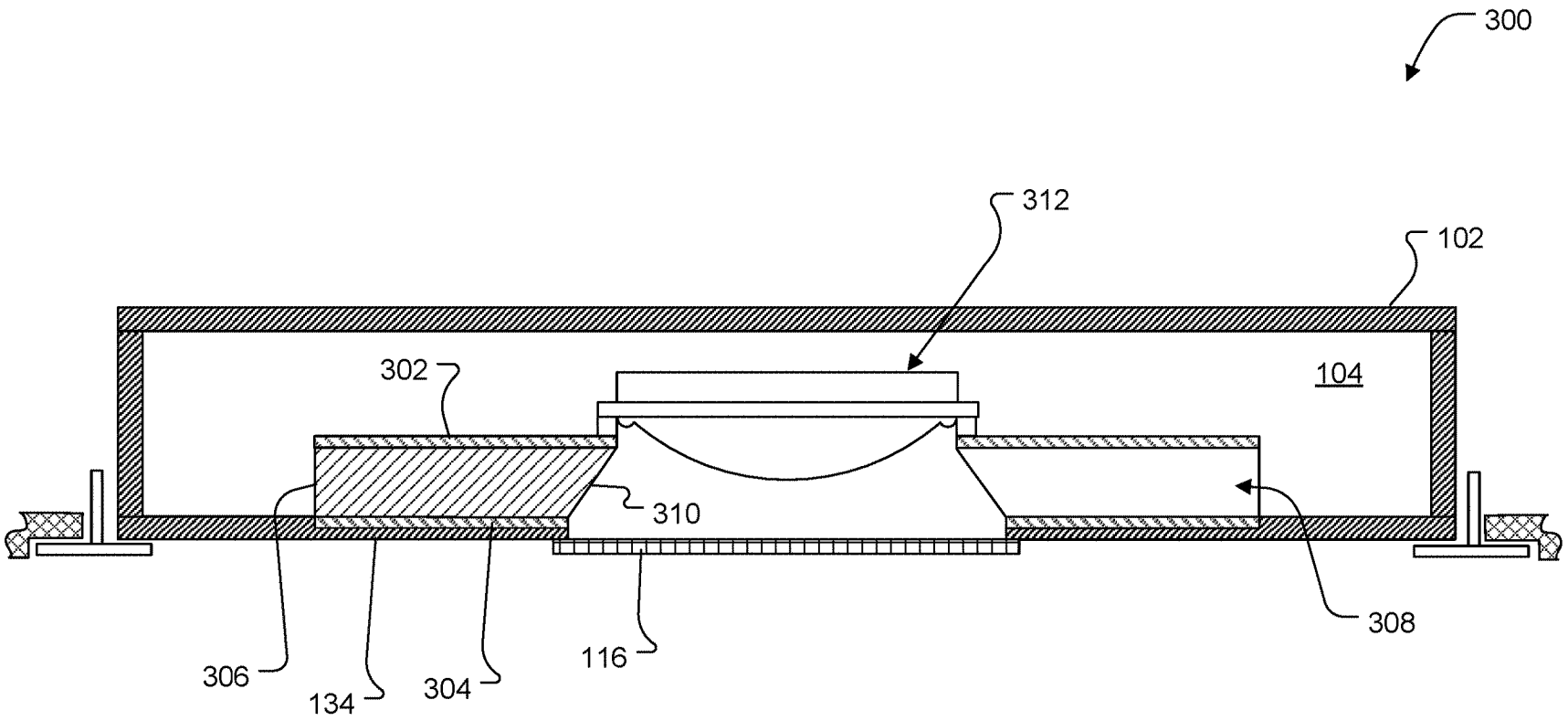
FIG. 3 is a cross-sectional side view of a second implementation of a ceiling tile loudspeaker shown installed in a cross-tee grid of a drop ceiling.
Figure 4:
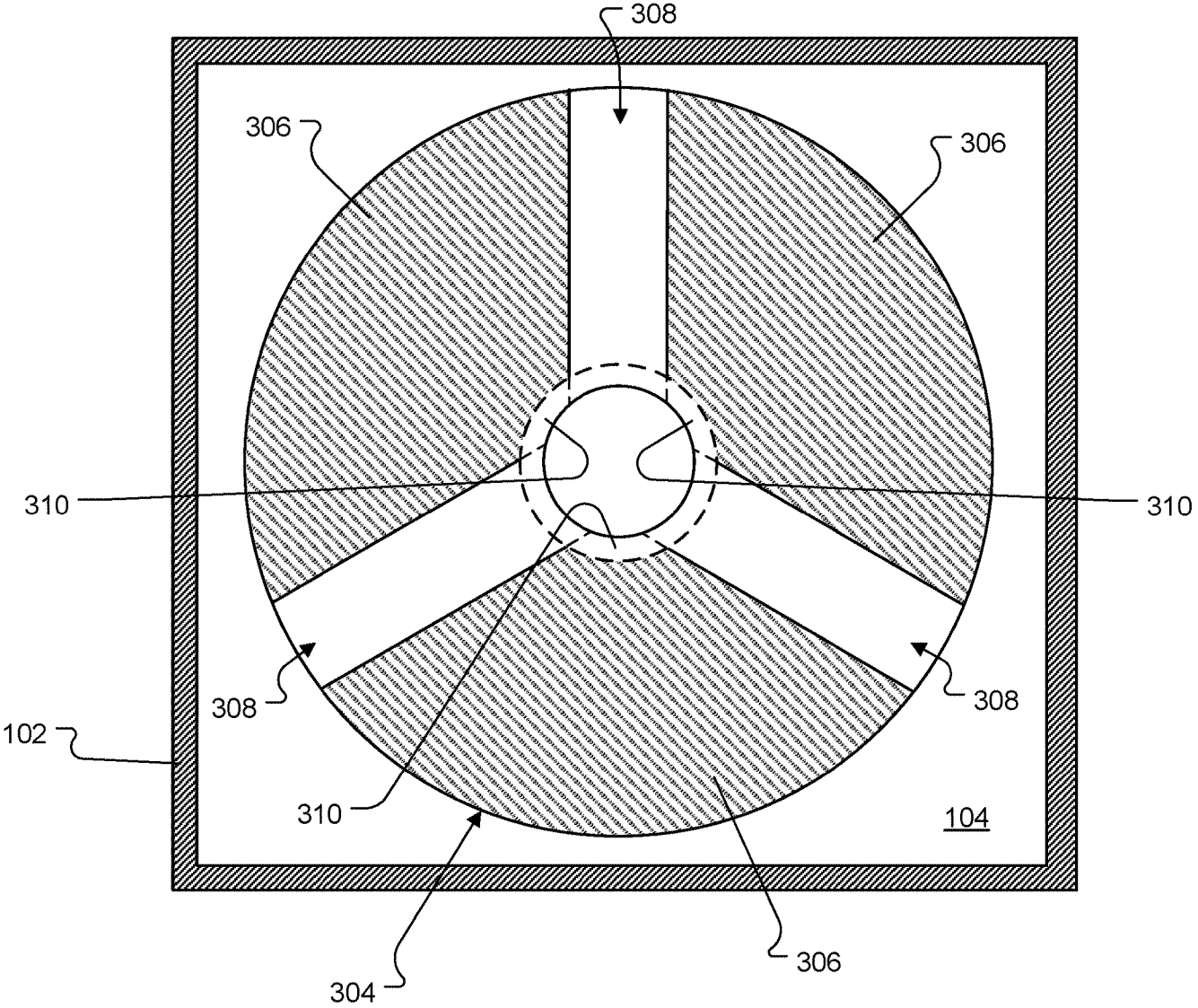
FIG. 4 is a top view of the ceiling tile loudspeaker of FIG. 3 shown with a top wall of an acoustic enclosure, an electro-acoustic transducer, and an upper baffle removed.

FIGS. 3 and 4 illustrate another implementation of a ceiling tile loudspeaker 300 in which the first (upper) baffle 302 is provided with a smaller opening than the second (lower) baffle 304 and/or the bottom wall 134 of the acoustic enclosure 102. In the illustrated implementation, the partitions 306 define substantially straight ports 308. Notably, respective inner edge surfaces 310 of the partitions 306 are tapered so as to form a waveguide around the second radiating surface of the electro-acoustic transducer 312. This configuration may be used, for example, with a full range electro-acoustic transducer 312 (FIG. 3), i.e., to providing a waveguide (as defined by the tapered inner edge surfaces 310 of the partitions 306) for the full range driver. As used herein the term "full range electro-acoustic transducer" and/or "full range driver" should be understood to mean an electro-acoustic transducer having an operating frequency range of about 20 Hz to about 20 kHz. While FIGS. 3 & 4 depict an implementation with substantially straight ports, in other implementation curved ports may be utilized.

Figure 5:
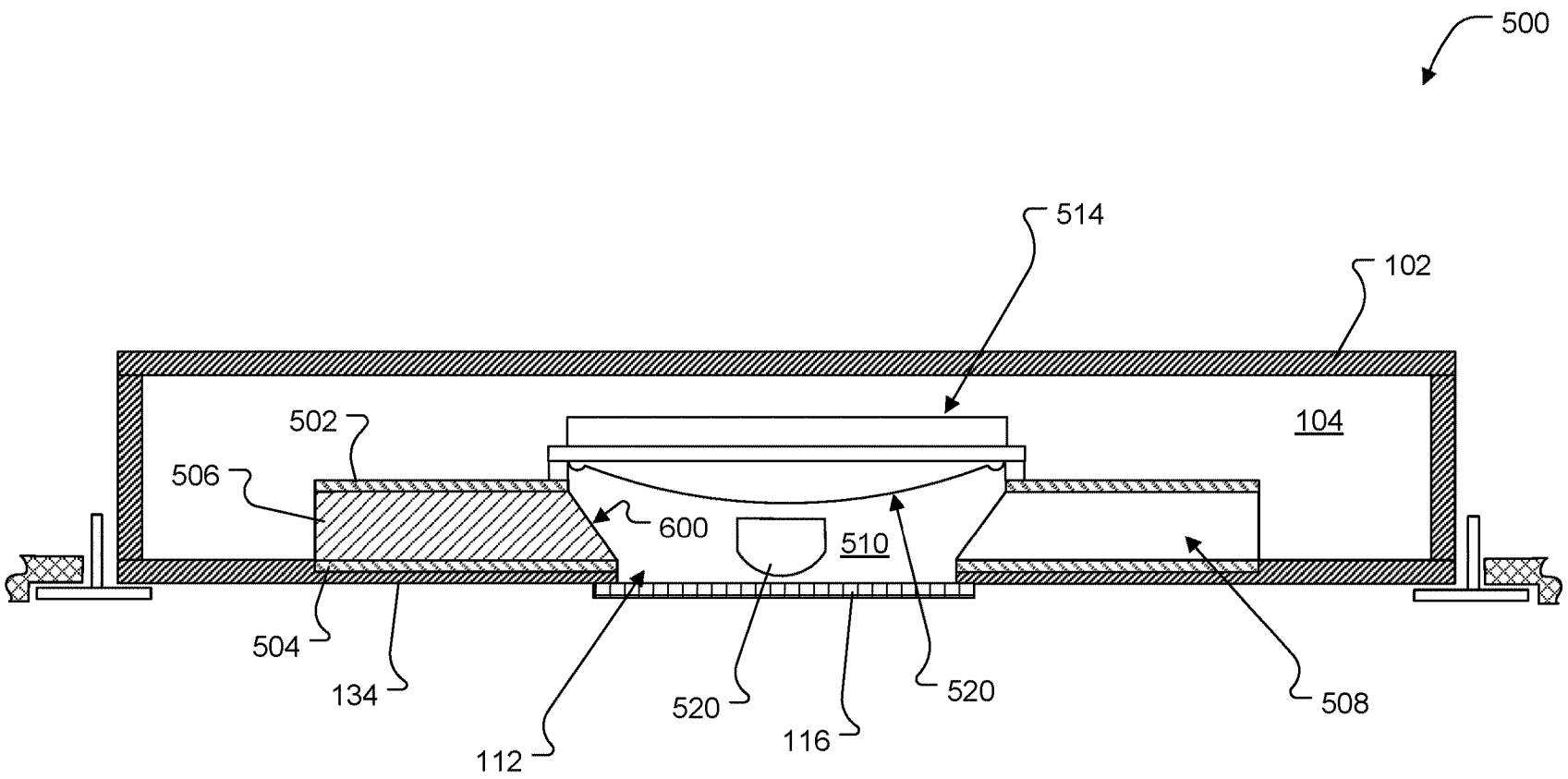
FIG. 5 is a cross-sectional side view of a third implementation of a ceiling tile loudspeaker shown installed in a cross-tee grid of a drop ceiling.
Figure 6:
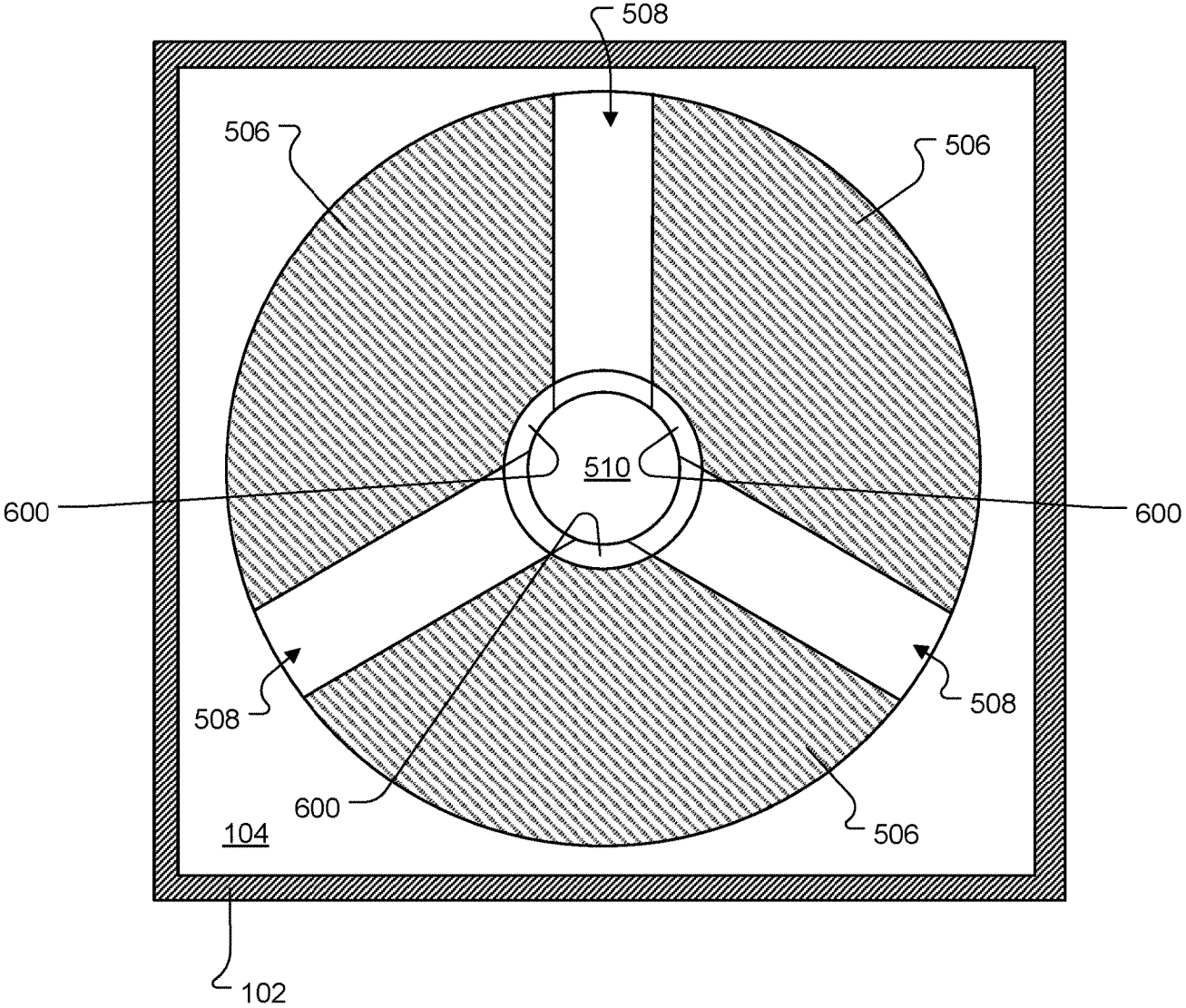
FIG. 6 is a top view of the ceiling tile loudspeaker of FIG. 5 shown with a top wall of an acoustic enclosure, an electro-acoustic transducer, and an upper baffle removed.

FIGS. 5 and 6 illustrate yet another implementation of a ceiling tile loudspeaker 500 in which the first (upper) baffle 502 is provided with a larger opening than the second (lower) baffle 504 and/or the bottom wall 134 of the acoustic enclosure 102. In the example illustrated in FIGS. 5 and 6, the partitions 506 define substantially straight ports 508 and the inner edge surfaces 600 (FIG. 6) of the partitions 506 are tapered to form a substantially funnel shaped cavity 510 between the second radiating surface 512 of the electro-acoustic transducer 514 and the opening 112 in the acoustic enclosure 102 such that acoustic energy radiated from the second surface 512 of the electro-acoustic transducer 514 is funneled towards the opening 112. In some cases, a phase plug 520 may be disposed within the funnel shaped cavity 510 to extend high frequency response by guiding waves outward rather than allowing them to interact destructively near the electro-acoustic transducer 514. The phase plug 520 may be formed integrally with one of the baffles 502, 504 or with the partitions 506.

Figure 7:
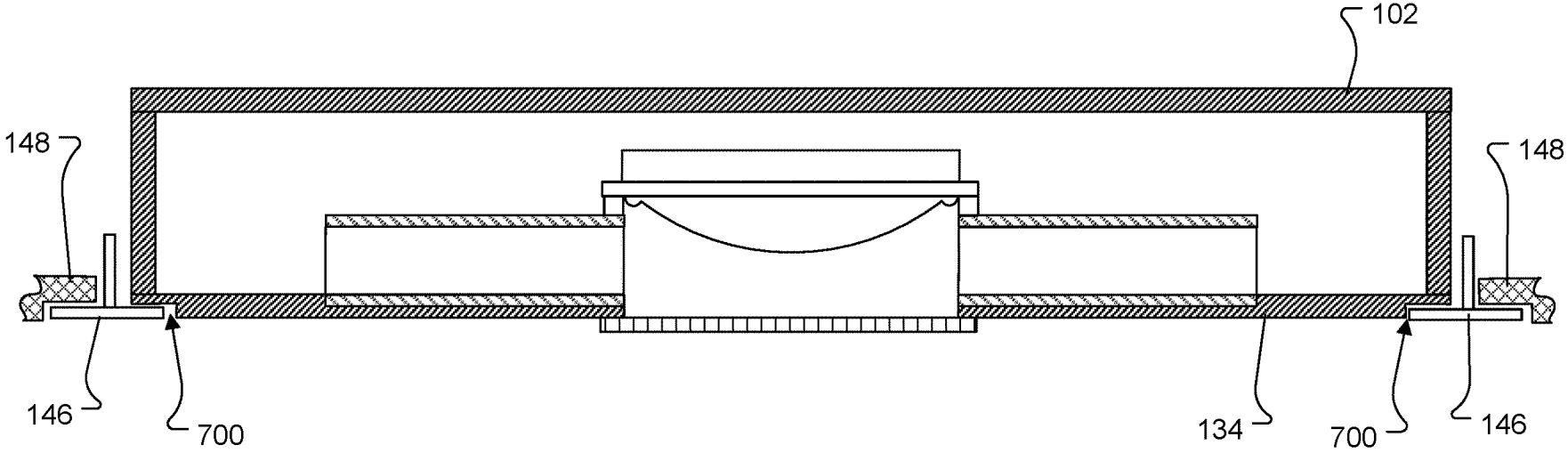
FIG. 7 is a cross-sectional side view of a fourth implementation of a ceiling tile loudspeaker with recesses for engaging a cross-tee grid of a drop ceiling.

With reference to FIG. 7, in some implementations the acoustic enclosure 102 may include a recess 700 around the periphery of the bottom surface of the bottom wall 134. The recess 700 can be configured to accommodate a cross-tee member 146 of a drop ceiling grid to allow the bottom surface of the bottom wall 134 of the acoustic enclosure 102 to hang below the support surface of the cross-tee member 146, e.g., such that the bottom surface of the bottom wall 134 of the acoustic enclosure 102 is substantially level with the bottom surfaces of adjacent ceiling tiles 148.

A number of implementations have been described. Nevertheless, it will be understood that additional modifications may be made without departing from the scope of the inventive concepts described herein, and, accordingly, other implementations are within the scope of the following claims.

What is claimed is:

1. A ceiling tile loudspeaker comprising:

an acoustic enclosure defining an acoustic cavity;

an electro-acoustic transducer supported by the enclosure such that a first radiating surface of the electro-acoustic transducer radiates acoustic energy into the acoustic cavity and a second radiating surface of the electro-acoustic transducer radiates acoustic energy outward away from the acoustic enclosure;

a first baffle disposed within the acoustic cavity; and a plurality of partitions, which, together with the first baffle, defines a plurality of ports that acoustically couple the acoustic cavity to an exterior of the enclosure, wherein each of the plurality of ports includes a first open end, a second open end, and a substantially straight central axis extending therebetween, and wherein the ports are arranged such that their respective first open ends, second open ends, and central axes all lie in a plane that is substantially perpendicular to a motion axis of the electro-acoustic transducer.

2. The ceiling tile loudspeaker of claim 1, wherein each of the ports has substantially constant cross-section area along its length from the first open end to the second open end.

3. The ceiling tile loudspeaker of claim 1, wherein the plurality of partitions comprises a plurality of ribs.

4. The ceiling tile loudspeaker of claim 3, wherein the plurality of partitions further comprises a plurality of bulbs disposed at distal ends of respective ones of the ribs, wherein the bulbs help to keep the respective cross-sectional areas of the ports constant.

5. The ceiling tile loudspeaker of claim 1, wherein respective inner edge surfaces of the partitions are tapered so as to form a waveguide around the second radiating surface of the electro-acoustic transducer.

6. The ceiling tile loudspeaker of claim 5, wherein the electro-acoustic transducer is a full-range driver.

7. The ceiling tile loudspeaker of claim 1, wherein the acoustic enclosure defines a first opening through which the second surface of the electro-acoustic transducer radiates acoustic energy, and wherein respective inner edge surfaces of the partitions are tapered to form a substantially funnel shaped cavity between the second radiating surface of the electro-acoustic transducer and the first opening such that acoustic energy radiated from the second surface of the electro-acoustic transducer is funneled towards the first opening.

8. The ceiling tile loudspeaker of claim 7, wherein a phase plug is disposed within the funnel shaped cavity.

9. The ceiling tile loudspeaker of claim 1, wherein the partitions are configured to direct an air flow exhausted from the ports around the motion axis of the electro-acoustic transducer, such that a vector of maximum flow velocity exiting each of the ports from its second open end is not perpendicular to the motion axis of the electro-acoustic transducer.

10. The ceiling tile loudspeaker of claim 1, wherein the second open ends of the ports are arranged in a radial array about the motion axis of the electro-acoustic transducer.

11. The ceiling tile loudspeaker of claim 1, wherein the acoustic enclosure is configured to rest within a 2 foot by 2 foot opening in a drop ceiling.

12. The ceiling tile loudspeaker of claim 1, further comprising:

a first opening in acoustic enclosure; and a second opening in the first baffle, wherein the electro-acoustic transducer is mounted to the first baffle such that acoustic energy radiated from the second radiating surface of the electro-acoustic transducer passes through the first and second openings, and wherein the second open ends of the ports are arranged to exhaust an air flow into a cavity disposed between the second radiating surface of the electro-acoustic transducer and the first opening.

13. The ceiling tile loudspeaker of claim 1, wherein the electro-acoustic transducer is a subwoofer.

14. The ceiling tile loudspeaker of claim 1, wherein the partitions are formed integrally with the first baffle.

15. The ceiling tile loudspeaker of claim 1, further comprising a second baffle, wherein the partitions are disposed between the first and second baffles, and wherein the first and second baffles and the partitions together define the ports.

16. The ceiling tile loudspeaker of claim 15, wherein the partitions are formed integrally with the second baffle.

17. The ceiling tile loudspeaker of claim 15, further comprising a recess formed within a bottom wall of the acoustic enclosure to receive the second baffle.

18. The ceiling tile loudspeaker of claim 1, further comprising a recess formed about an outer periphery of a bottom surface of a bottom wall of the acoustic enclosure, the recess being configured to engage cross-tee members of a drop ceiling to support the ceiling tile loudspeaker.

19. A ceiling tile loudspeaker comprising:

an acoustic enclosure defining an acoustic cavity and a first opening;

an electro-acoustic transducer supported by the enclosure such that a first radiating surface of the electro-acoustic transducer radiates acoustic energy into the acoustic cavity and a second radiating surface of the electro-acoustic transducer radiates acoustic energy outward away from the acoustic enclosure;

a first baffle disposed within the acoustic cavity, the first baffle defining a second opening; and a plurality of partitions, which, together with the first baffle, defines a plurality of ports that acoustically couple the acoustic cavity to an exterior of the enclosure, wherein each of the plurality of ports includes a first open end, a second open end, and a substantially straight central axis extending therebetween, wherein the ports are arranged such that their respective first open ends, second open ends, and central axes all lie in a plane that is substantially perpendicular to a motion axis of the electro-acoustic transducer, wherein the electro-acoustic transducer is mounted to the first baffle such that acoustic energy radiated from the second radiating surface of the electro-acoustic transducer passes through the first and second openings, and wherein the second open ends of the ports are arranged to exhaust an air flow into a cavity disposed between the second radiating surface of the electro-acoustic transducer and the first opening.

20. The ceiling tile loudspeaker of claim 19, wherein the plurality of partitions comprises a plurality of ribs.

21. The ceiling tile loudspeaker of claim 19, wherein the plurality of partitions further comprises a plurality of bulbs disposed at distal ends of respective ones of the ribs, wherein the bulbs help to keep the respective cross-sectional areas of the ports constant.

22. The ceiling tile loudspeaker of claim 19, wherein the partitions are configured to direct an air flow exhausted from the ports around the motion axis of the electro-acoustic transducer, such that a vector of maximum flow velocity exiting each of the ports from its second open end is not perpendicular to the motion axis of the electro-acoustic transducer.

23. The ceiling tile loudspeaker of claim 19, wherein the second open ends of the ports are arranged in a radial array about the motion axis of the electro-acoustic transducer.

24. The ceiling tile loudspeaker of claim 1, wherein the second radiating surface of the electro-acoustic transducer is in the form of dome having a convex shape that extends at least partially into an exhaust cavity that is acoustically coupled to an exterior of the acoustic enclosure via an opening in the acoustic enclosure.

* * * * *